US008636624B2

(12) United States Patent
Liberman et al.

(10) Patent No.: US 8,636,624 B2
(45) Date of Patent: Jan. 28, 2014

(54) ROTATIONAL EDUCATIONAL ENTERTAINMENT AND THERAPEUTIC DEVICE

(75) Inventors: Glen Liberman, Short Hills, NJ (US); Ben Hopson, Brooklyn, NY (US)

(73) Assignee: Kinekt Design, LLC, Livingston, NJ (US)

( * ) Notice: Subject to any disclaimer, the term of this patent is extended or adjusted under 35 U.S.C. 154(b) by 306 days.

(21) Appl. No.: 13/066,429

(22) Filed: Apr. 14, 2011

(65) Prior Publication Data

US 2012/0090356 A1 Apr. 19, 2012

Related U.S. Application Data

(60) Provisional application No. 61/342,459, filed on Apr. 14, 2010.

(51) Int. Cl.
*A63B 21/00* (2006.01)

(52) U.S. Cl.
USPC ..... 482/44; 482/148; 16/431; 16/110.1; 16/421; 434/258; 601/40; 601/131

(58) Field of Classification Search
USPC ..... 482/44, 49, 148; 16/431, 421, 110.1; 434/258; 601/40, 131
See application file for complete search history.

(56) References Cited

U.S. PATENT DOCUMENTS

| | | | | | |
|---|---|---|---|---|---|
| 1,710,051 | A * | 4/1929 | Giacopazzi | ..... | 601/127 |
| 5,299,991 | A * | 4/1994 | Sato | ..... | 482/44 |
| 5,358,463 | A * | 10/1994 | Fuentes | ..... | 482/141 |
| D385,319 | S * | 10/1997 | Lucas | ..... | D21/684 |
| 6,001,050 | A * | 12/1999 | Delf | ..... | 482/122 |
| 7,241,251 | B2 * | 7/2007 | Patterson | ..... | 482/93 |
| 7,967,732 | B2 * | 6/2011 | D'Addario et al. | ..... | 482/47 |

* cited by examiner

*Primary Examiner* — Jerome W Donnelly
(74) *Attorney, Agent, or Firm* — Spriegel & Associates, LLC

(57) ABSTRACT

A cylindrical gear ring assembly is provided for use as a decorative wearable ornamental device useable as a ring or other piece of jewelry, a toy, and a therapy tool, and more specifically to a ring with a rotatable mechanism comprising movable cylinders which rotate against gear mechanisms and method of using the same.

17 Claims, 2 Drawing Sheets

ROTATIONAL EDUCATIONAL ENTERTAINMENT AND THERAPEUTIC DEVICE

REFERENCE TO RELATED APPLICATIONS

This invention claims priority to and the benefit of U.S. Provisional Application Ser. No. 61/342,459 which was filed Apr. 14, 2010, entitled ROTATING EDUCATIONAL ENTERTAINMENT AND THERAPEUTIC DEVICE, the entirety of which is hereby incorporated by reference as if fully set forth herein.

FIELD OF THE INVENTION

The invention relates generally to a decorative wearable ornamental device useable as a ring or other piece of jewelry, a toy, and a therapy tool, and more specifically to a ring with a rotatable mechanism comprising movable cylinders which rotate against gear mechanisms and method of using the same.

BACKGROUND OF THE INVENTION

The present invention relates generally to jewelry or decorative wearable items or educational toys or physical or mental therapy tools, and more particularly to a combination of cylindrical rings which readily rotate against a variety of gear mechanisms. Although the prior art teaches many devices for use as decorative jewelry, all of these teachings demonstrate limitations that the present invention addresses and overcomes.

Toys, jewelry, wearable items, educational toys, physical or mental therapy tools, and other tools with rotation features are well known in the art. Gear assemblies with a plurality of mechanisms have many uses as toys or other tools for improving many devices.

U.S. Pat. No. 3,486,269 to Fischer describes a wheel capable of transmitting motion through friction as it contacts a second rotary element for use in devices such as toys. This allows for the construction of toys where the accuracy of gear transmission is not necessary in order to keep construction and manufacturing costs down. However, this invention is not well suited to use as a ring or piece of wearable jewelry as it teaches motion transmission for the purpose of performing work to drive a gear shaft. Also, there is no teaching that this mechanism may have use for mental stimulation or therapy purposes.

In another example, U.S. Pat. No. 5,194,031 to Sahler uses a ring gear assembly as part of a toy used for amusement and educational purposes. The device is purportedly useful as an educational tool for teaching the relationship between a ring gear and a drive gear to demonstrate rotational motion. However, this invention also has limitations that would restrict its use as a piece of wearable jewelry or as an easily portable therapy device. This device requires the gear mechanisms to be mounted to a board in a specific relationship to each other. Therefore, it is not wearable or portable by design.

Despite the prior art, there is still a need for additional entertaining devices which utilize rotation elements to produce movement. An additional need exists for devices that teach basic mechanical associations such as a gear and cog mechanism to promote education in the science and engineering fields in a simple and engaging manor. There is also a need for wearable devices designed as a physical therapy tool to help improve or maintain fine motor function as people age or otherwise begin to lose or have lost "normal mental/motor function." Another need exists for wearable movable devices that are helpful with the relief of stress or anxiety such as for people affected by obsessive compulsive disorder or attention deficit disorder. An additional rehabilitative need exists for a device that may improve or maintain cognitive function for individuals who have declining cognitive states whether from natural causes, brain injury, or disease such as Alzheimer's disease. Finally, there is always a need for decorative wearable jewelry capable of identification of marriage or other social status that is visually pleasing, movable, enjoyable to wear and distinctive.

SUMMARY OF THE INVENTION

Accordingly, the present invention overcomes the limitations of the prior art by providing a geared ring assembly including a first geared ring component and a second geared ring component that revolve in opposite directions when an assembly is manipulated. The other rotating assembly is driven in the opposite direction by a drive spur gear that lies between and makes contact with the ring assemblies along an inner annular surface designed to be worn on a finger like a decorative piece of jewelry. Accordingly it is a primary object of the invention to provide a new interactive and educational gear assembly device capable of demonstrating basic mechanical movements that may be worn on an appendage as a piece of decorative art.

Consequently, the following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as to preclude the more detailed description that is presented later.

It is an object of the present invention to provide a device useable as a decorative cylindrical ring assembly comprising first and second gear wheels capable of rotating in opposite directions across a plurality of gear mechanisms when manipulated.

It is another object of the invention to provide a toy gear assembly in the form of a wearable piece of jewelry.

Another object of the invention is to provide a device for exercising and improving fine motor and cognitive skills.

An even further object of the present invention is to provide a toy gear assembly comprising a base assembly on which an inner gear engages outer cogwheels that rotate in opposite directions.

It is a further object of the invention to provide a therapeutic treatment for stress or anxiety.

An even further object of the invention is to provide an educational tool for a mechanical rotational motion.

An additional object of the invention is to provide a method of maintaining or improving motor or cognitive skills by manipulating a rotatable gear wheel assembly.

Another object of the invention is to provide a form of entertainment.

It is yet another object of the invention to provide a method of therapeutic relaxation.

BRIEF DESCRIPTION OF THE DRAWINGS

Embodiments of the invention will now be described with reference to the accompanying drawings.

DETAILED DESCRIPTION OF THE INVENTION

Figure 1:
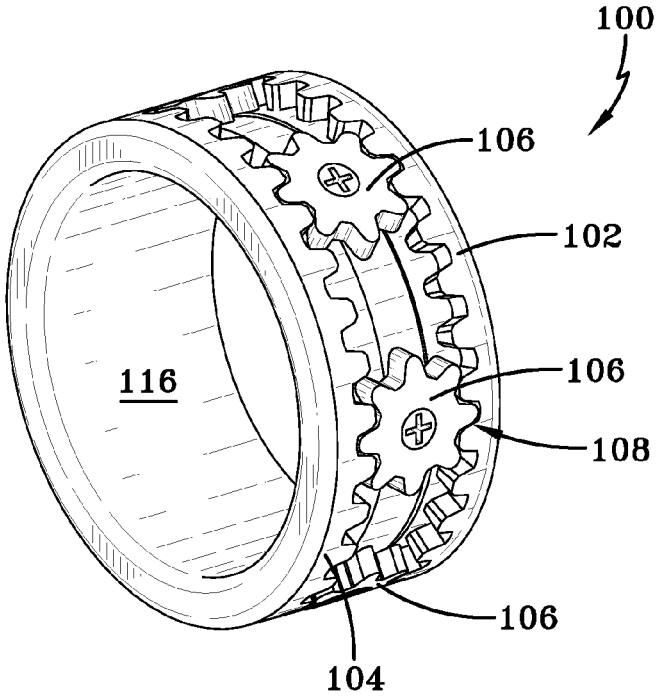
FIG. 1 is a perspective view of a gear ring assembly illustrating one embodiment of the present invention.

One or more implementations of the present invention will now be described with reference to the attached drawings, wherein like reference numerals are used to refer to like elements throughout. The gear assembly of the present invention is adapted to supply a variety of amusing, educational, and therapeutic devices which do not currently exist.

Figure 2:
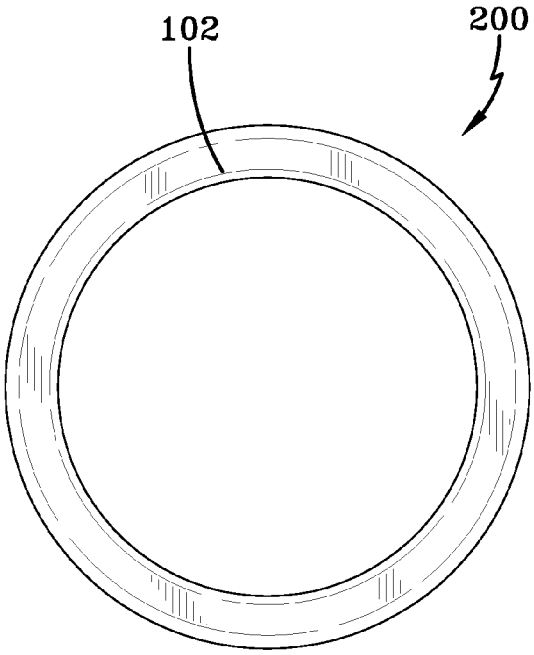
FIG. 2 is a top view of the gear ring assembly illustrated in FIG. 1, according to yet another embodiment of the present invention.
Figure 3:
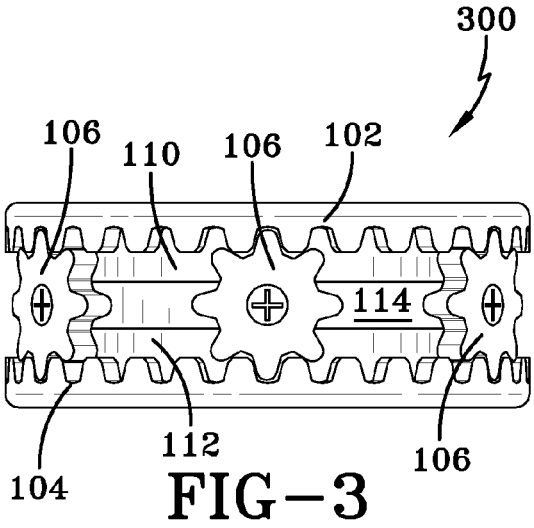
FIG. 3 is a side view of the gear ring assembly shown in FIG. illustrating yet another embodiment of the present invention.

Referring now to the drawings, FIGS. 1-3 shows a geared ring assembly device 100, 200 and 300 that comprises a first annular gear wheel 102 and a second annular gear wheel 104 that revolve in opposite directions when the device 100, 300, 300 is manipulated and driven by a plurality of drive gear mechanisms 106. Moving the first annular gear wheel 102 or the second annular gear wheel 104 or any of the plurality of drive gear mechanisms 106 will drive the other geared components. For example, turning a first drive gear mechanism 108 will result in the turning and/or movement of the remainder of the plurality of drive gear mechanisms 106, the first annular gear wheel 102 and the second annular gear wheel 104. Although the inventors in this embodiment are utilizing spur gears as the drive gear mechanisms 106 and geared ring components as the first and second annular gear wheels 102, 104, one skilled in the art could use other gears and gear assemblies to create similar embodiments.

For example, the drive gear mechanisms 106 can comprise wheels and pinions, rack and pinion gears, ring gears, planetary gears, master and servant gears, noncircular gears, face gears, internal and external gears, helical gears, worm gears, bevel gears, non-circular gear rack, internal gears, sprockets, and the like. In addition, the geared ring assembly device 100, 200, 300 can have different internal shapes (i.e., where the finger is inserted) and external shapes comprising squares, polygons, other uniform geometrical metal shapes, ovals, circles, hexagons, rectangles, non-uniform shapes and not depart from the scope of the invention. Those skilled in the art will recognize many modifications that may be made to this configuration, without departing from the scope or spirit of what is described herein.

Figure 4:
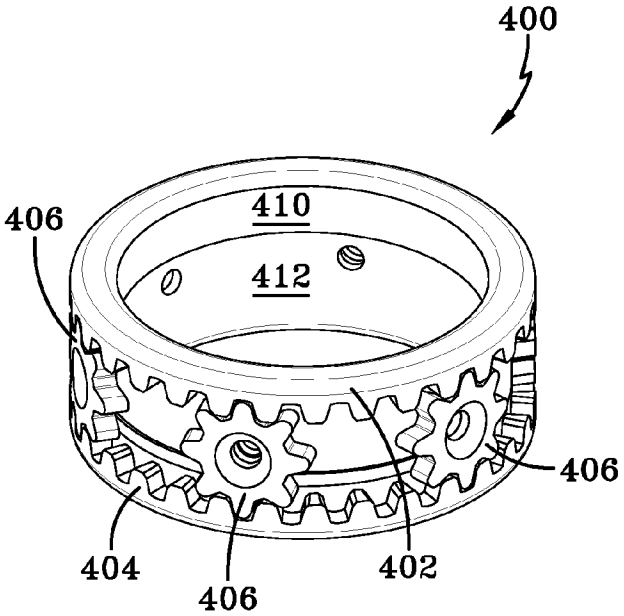
FIG. 4 is a perspective view of a second gear ring assembly illustrating another embodiment of the present invention.

Referring again to the embodiments illustrated in FIGS. 1-3, the geared ring assembly device 100, 200, 300 also comprises an interconnecting ring 114, an upper gear lock ring (shown in FIG. 4 as 410) and a lower gear lock ring (shown in FIG. 4 as 412). An inner ring base surface 116 is smooth allowing the user to wear it on a finger like a piece of jewelry. Once the device 100, 200, 300 is assembled, the inner ring base surface 116 is sanded until it is substantially smooth to the wearer. In addition, once assembled, the inner surface of the geared ring assembly 100 fasteners can be modified using known smoothing techniques comprising flattening, pressing, filing, rasping, brushing, sanding, grounding, and other techniques known by those of skill in the art.

Figure 5:
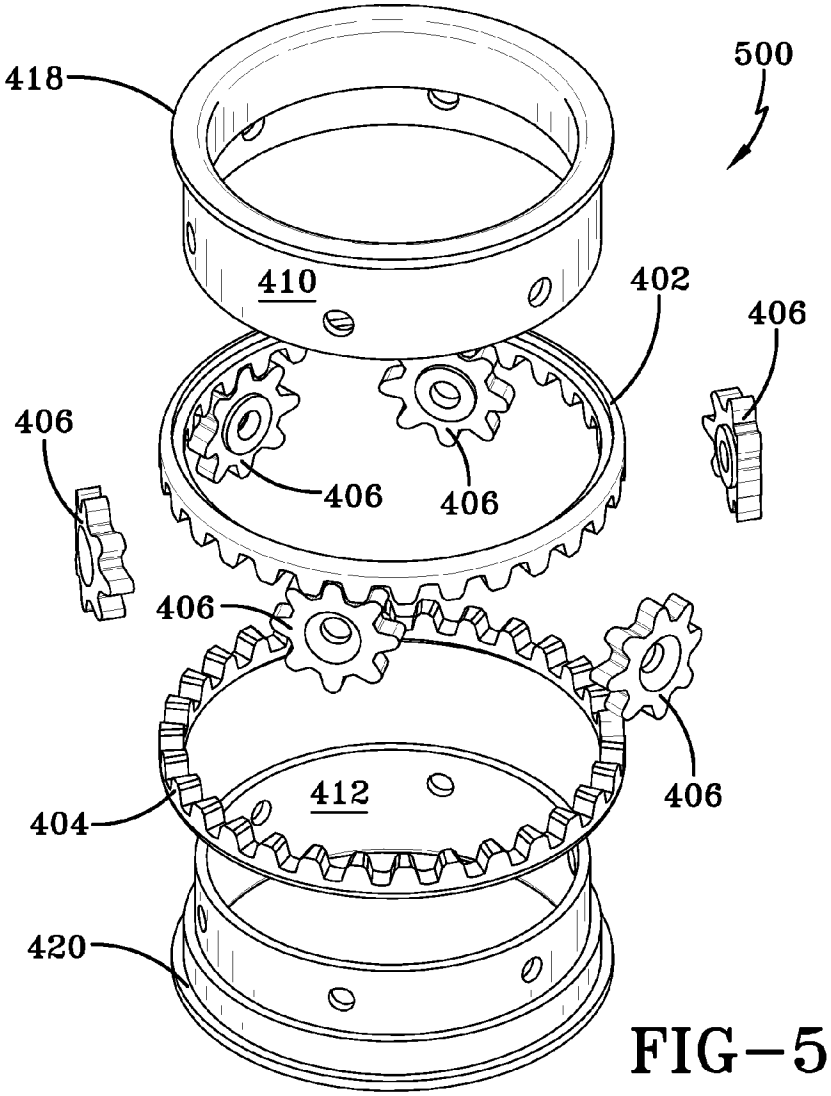
FIG. 5 is an exploded view of the second gear ring assembly illustrated in FIG. 4 according to yet another embodiment of the present invention.

Referring now to FIGS. 4-5, a geared ring assembly device 400 and 500 is illustrated. The devices 400, 500 comprise a first annular gear wheel 402 and a second annular gear wheel 404 that revolve in opposite directions when the device 400, 500 is driven by manipulated by a plurality of drive gear mechanisms 406. While the drive gear mechanisms 406 in this embodiment are spur gears, the inventor has contemplated any other similar type of gear that can drive the device 400, 500, well known by those of skill in the art. Moving the first annular gear wheel 402 or the second annular gear wheel 404 or any of the plurality of drive gear mechanisms 406 will drive the other geared components of the device 400, 500. For example, turning a first drive gear mechanism 408, which may be any of the drive gear mechanisms 406, will result in the turning and/or movement of the remainder of the plurality of drive gear mechanisms 406, the first annular gear wheel 402 and the second annular gear wheel 404. As discussed supra, that although the inventors are utilizing spur gears as the drive gear mechanisms 408, 408 and geared ring components as the first and second annular gear wheels 402, 404, one skilled in the art could use other gears and gear assemblies in similar embodiments and still be within the scope of the invention.

The geared ring assembly device 400, 500 also comprises an upper gear lock ring 410, a lower gear lock ring 412, and an inner ring base surface 416 that is smooth allowing the user to wear the device 400, 500 on a finger like a piece of jewelry. Once the device 400, 500 is assembled as for example a ring, the inner base surface 116 is sanded until it is substantially smooth to the wearer. The inner base surface 116 provides a base for the rest of the device 400, 500 to rest on and further comprises annular lips 418, 420 extending outward that keeps the other device elements in place on the outer surface of the base. The entire device 400, 500 may be made of materials comprising any combination of non-uniform or uniform substantially rigid material such as a precious metal, gold, silver, and platinum, any mineral, any precious or non-precious gem stone, alloys, stainless steel, brass, tin, aluminum, plastic, resin, PVC, polypropylene, polycarbonate, or any other machinable material, and the like. Additionally, the scope of the invention contemplates different device elements being made of different materials, for example glass, precious stones, gems and metals in various combinations.

The first annular gear wheel 402 and the second annular gear wheel 404 adjacent to the respective annular lips (418 and 420) are of a diameter that allows them to be contained and yet be freely moveable on the upper gear lock ring 410 and the lower gear lock ring 412, respectively. The upper gear lock ring 410 and a lower gear lock ring 412 are attached utilizing fasteners inserted through the center of the drive gear mechanisms 106 into an outer through hole 422 in the upper gear lock ring 410 and an inner through hole 422 in the lower gear lock ring 412. The end of the fastener can be detachable or filed or machined off, for example on the lower gear lock ring 412 creating a smooth surface along the inner ring base surface 116 so that the device may be worn on a finger or toe comfortably. The fasteners may comprise screws, nails, brads, pins, rivets, dowels, and the like. The plurality of drive gear mechanisms 406 have a plurality of gear teeth or cogs that fit between the gaps of a plurality of teeth on the inward facing portions of the first and second annular gear wheels 402, 404 respectively.

To engage the rotating mechanism of the device 400, 500, the rotating element engages the rotating wheels to allow rotation of the gear mechanisms and the outer ring elements at the same time. In other words, the plurality of drive gear mechanisms 406 run in relation to the circular pinion outer gears of the first and second annular gear wheels 402, 404 to produce complimentary movements of the outer rotating first and second annular gear wheels 402, 404 in opposite directions. All gears turn in unison when one of the outer gear wheels is spun. The rotation is created when the plurality of teeth on one of the first or second annular gear wheels 402, 404 engages the notches between the plurality of gear teeth of the plurality of drive gear mechanisms 406 which simultaneously transfers the movement in the opposite direction to the opposite outer wheel 402, 404 respectively.

The inner cylindrical ring assembly base (not numbered) comprises a first side (410 and 418 combined) and a second side (410, 412, and 420 combined) each with a central axis and an inner diameter that combined forms the inner ring base surface 116 that is substantially smooth but has the plurality of through holes 422 for accepting a fastening mechanism such as a screw or any other fastening mechanism that is known in the art. The first side and the second side are of slightly different diameters so that the larger side fits firmly on top of the other side to create a single integrated inner cylindrical ring assembly base with the plurality of through holes 422 aligned. Additionally each of the first and second sides has an annular lip 418, 420 respectively that extends outward perpendicular to the diameter or the first or second side respectively that is used to keep the other device 400, 500 elements in place once assembled. Another embodiment of the inner cylindrical ring assembly base has the inner first side configured as a shelf or ledge where the outer second side fits into place in a step joint and the outer second side is not as wide as the inner first side (see FIG. 5). The shelf joint is grooved into the inner first side at an annular position proximal to the plurality of through holes 422 through the member. This creates a uniform inner diameter with the use of less material.

Next, the first and second annular gear wheels 402, 404 have a greater diameter than the inner cylindrical ring assembly base. When the device 400, 500 is assembled, the first and second annular gear wheels 402, 404 lie on the outer diameter surface of the inner cylindrical ring assembly base so that the plurality of teeth of the first and second annular gear wheels 402, 404 are facing inward across the inner cylindrical ring assembly base surface where the outer rims of the first and second annular gear wheels 402, 404 are held in place and ride along the inner edge of the annular lips 418, 420. Additionally, the plurality of drive gear mechanisms 406 are rotatebly attached to the inner cylindrical ring assembly base by using the through holes 422 in the inner cylindrical ring assembly base. Once attached, the inner surface of the attaching mechanisms are flattened or otherwise integrated into the inner ring base surface 116 of the inner cylindrical ring assembly base inner diameter to create a substantially smooth surface.

Each of the plurality of drive gear mechanisms 406 have a plurality of teeth or cogs used to match up with the teeth or cogs of the first and second annular gear wheels 402, 404 and drive the rotational movement of the wheel and gear assembly. The inner drive gear mechanisms 406 turn in unison when an outer annular gear wheel 402 or 404 is rotated causing the reverse rotation of the other annular gear wheel 402 or 404. The gear mechanisms may be used to create an electrical current used for a variety of options such as powering a light or sound attachment without the need for an external power source. Additional embodiments contemplate the ability to connect a plurality of rings or the face of the ring may have a surface perpendicular to the ring assembly with an additional set of gear mechanisms of a variety of designs for rotational or linear movement of the gear elements along the face.

The device 100 of FIG. 1 has three elements comprising the cylindrical ring assembly, however for simplicity, we will describe how the device of FIG. 5 is assembled knowing that one skilled in the art would be easily able to assemble a cylindrical ring assembly with three elements. In FIG. 5, the first and second annular gear wheels 402, 404 are slid on top of the cylindrical assembly's first and second sides until they bottom out on the raised annular lip elements 418, 420. Next the first side and the second side of a smaller diameter are slid over one another until the shelf joint makes contact in an annular position where the through holes 422 are aligned. Then the inner drive gear mechanisms 406 are placed in between the first and second annular gear wheels 402, 402 so that the teeth elements of all of the drive gear mechanisms 406 and first and second annular gear wheels 402, 404 are interconnected and aligned. The inner drive gear mechanisms 406 must also be aligned so that the base through-holes 422 are visible through the center. Next, fastening mechanism s is press fit through the center of the drive gear mechanisms 406 and through the base for each gear and the attachment is made. Finally, the inner surface of the fastener is ground or filed so that the inner diameter of the inner ring base surface 116 is smooth.

Another embodiment of the invention includes a method of relaxation or therapy. In this embodiment, a device as described supra is worn on a finger and used as an exercise tool. By using a finger to manipulate a fine mechanical gear mechanism, the user must concentrate on the task, which requires mental concentration and dexterity. This manipulation is useful as a rehabilitative or preventative form of exercise. Repetitive motion exercise such is created by using the device is also a useful relaxation tool for individuals experiencing stress, anxiety, or for any number of compulsive disorders. Having a wearable device creates a tool that is portable and useful in any situation where other traditional therapies may not be used, such as while riding in a car.

A variety of embodiments for the invention include uses as a decorative interactive piece of jewelry, a toy, an educational tool, and a therapeutic device. As an educational tool, this inexpensive portable device may be used to educate the user in a manor where they learn how a gear system works by observation and manipulation. By providing an educational tool that is fun and amusing to use, the repetitive motion will constantly reinforce the engineering principle behind the mechanism. An additional embodiment of the invention is as a social status identifier and conversation device. For example, the device may be used as a less than traditional wedding ring signifying that the wearer is married. The gear mechanism will not only entertain the wearer, but others who see the ring as well.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, systems, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application. Furthermore, to the extent that the terms "including", "includes", "having", "has", "with", or variants thereof are used in either the detailed description and the claims, such terms are intended to be inclusive in a similar manner to the term "comprising".

What is claimed is:

1. A device comprising a cylindrical ring assembly comprising a central axis and an inner diameter that is substantially smooth with holes for accepting a fastening mechanism;

the cylindrical ring assembly further comprising a first side of a larger diameter than a second side so that the larger diameter first side fits firmly on top of the second side creating an integrated single unit;

the first and second sides each comprising an annular lip extending perpendicular to an outer surface of the cylindrical ring assembly;

a first and second outer annular gear wheel of a larger diameter than the cylindrical ring assembly adjacent to the outer surface of the cylindrical ring assembly and held in position by the annular lips of the first and second sides;

the first and second annular gear wheels comprising a plurality of teeth facing inward across the outer surface of the cylindrical ring assembly; and, a plurality of drive gear mechanisms with a plurality of gear teeth capable of engaging the first and second outer annular gear wheels where the gears turn in unison when either the first or second outer gear wheel is rotated.

2. The device of claim 1, wherein the teeth comprise cogs, notches, fingers, and cylinders.

3. The device of claim 1, wherein the gear drive mechanisms comprise wheels and pinions, rack and pinion gears, ring gears, planetary gears, master and servant gears, noncircular gears, face gears, internal and external gears, helical gears, worm gears, bevel gears, non-circular gear rack, internal gears, and sprockets.

4. The device of claim 1, wherein the device material comprises a precious metal.

5. The device of claim 1, wherein the device material comprises gold, silver, platinum, minerals, precious or non-precious gem stones, alloys, stainless steel, brass, tin, aluminum, plastic, resin, PVC, polypropylene, and polycarbonate.

6. The device of claim 1, wherein the device is a ring.

7. The device of claim 1, wherein the device comprises a piece of jewelry, a piece of body art, a bracelet, an anklet, a necklace, a charm, and a broach.

8. The device of claim 1, wherein the device comprises a toy.

9. The device of claim 1, wherein the device is used for maintaining, exercising, or improving motor or cognitive skills.

10. The device of claim 1, wherein the device is used as a portable relaxation aid.

11. The device of claim 1, wherein the device is used as a part of a therapeutic treatment.

12. The device of claim 1, wherein the device is used as an educational tool.

13. A method of therapy for improving or maintaining motor or cognitive skills by using a wearable gear assembly device as a tool for improving or maintaining manual dexterity comprising the following steps:

placing the gear assembly device on a finger;

using a finger to rotatably manipulate a first or a second annular gear wheel; and, visualizing or feeling the movement of the first and second annular gear wheel in relation to a plurality of drive gear mechanisms.

14. The method according to claim 13, wherein the method is used as part of a relaxation program.

15. The method according to claim 13, wherein the method is used as part of an educational program.

16. The method according to claim 13, wherein the method is used to lessen anxiety, anger, stress, and other emotions.

17. The method according to claim 13, wherein the method is used for amusement.

* * * * *